US011443677B2

(12) United States Patent
Han et al.

(10) Patent No.: US 11,443,677 B2
(45) Date of Patent: Sep. 13, 2022

(54) DISPLAY PANEL, DISPLAY METHOD THEREOF, AND DISPLAY APPARATUS

(71) Applicant: BOE TECHNOLOGY GROUP CO., LTD., Beijing (CN)

(72) Inventors: Dongxu Han, Beijing (CN); Chi Zhang, Beijing (CN); Tieshi Wang, Beijing (CN); Zhongyuan Wu, Beijing (CN); Yongqian Li, Beijing (CN); Jinxia Hu, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 10 days.

(21) Appl. No.: 16/772,312

(22) PCT Filed: Feb. 19, 2020

(86) PCT No.: PCT/CN2020/075819

§ 371 (c)(1),
(2) Date: Jun. 12, 2020

(87) PCT Pub. No.: WO2020/186955

PCT Pub. Date: Sep. 24, 2020

(65) Prior Publication Data

US 2021/0225246 A1 Jul. 22, 2021

(30) Foreign Application Priority Data

Mar. 18, 2019 (CN) ..... 201910204871.8

(51) Int. Cl.
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2300/0452* (2013.01);
(Continued)

(58) Field of Classification Search
None
See application file for complete search history.

(56) References Cited

U.S. PATENT DOCUMENTS 9,262,977 B2 * 2/2016 Borgers ..... G09G 3/3648
2008/0150958 A1 * 6/2008 Higgins ..... G09G 3/2003 345/591

(Continued)

FOREIGN PATENT DOCUMENTS

CN 102723054 A 10/2012
CN 103366680 A 10/2013

(Continued)

OTHER PUBLICATIONS

International Search Report dated Apr. 29, 2020, issued in counterpart Application No. PCT/CN2020/075819 (11 pages).

(Continued)

*Primary Examiner* — Benjamin C Lee
*Assistant Examiner* — Emily J Frank
(74) *Attorney, Agent, or Firm* — WHDA, LLP

(57) ABSTRACT

The present disclosure relates to a display method of a display panel. The display method may include obtaining original luminance of three single color subpixels in each of the pixel units based on an image to be displayed; obtaining luminance compensation values of the three single color subpixels that need to be color compensated at a time of obtaining the luminance of the mixed color subpixel as the first substitute luminance; calculating luminance of the mixed color produced by the three single color subpixels in the pixel unit respectively based on each of the luminance of the three single color subpixels after color compensation; and setting input luminance of the single color subpixel having the smallest luminance of the mixed color as 0, and (Continued)

obtaining actual luminance of the other single color subpixels and the mixed color subpixel.

17 Claims, 5 Drawing Sheets

(52) U.S. Cl.
CPC ..... *G09G 2320/0242* (2013.01); *G09G 2330/021* (2013.01); *G09G 2360/16* (2013.01)

(56) References Cited

U.S. PATENT DOCUMENTS

| | | | | |
|---|---|---|---|---|
| 2009/0040207 | A1 | 2/2009 | Park et al. | |
| 2011/0285738 | A1* | 11/2011 | Hsieh | G09G 5/02 345/589 |
| 2012/0236016 | A1* | 9/2012 | Fujino | G09G 3/3241 345/589 |
| 2013/0070007 | A1* | 3/2013 | Park | G09G 3/3233 345/694 |
| 2015/0049124 | A1* | 2/2015 | Yang | G09G 5/022 345/690 |
| 2016/0253942 | A1 | 9/2016 | Tseng et al. | |
| 2017/0061903 | A1* | 3/2017 | Yata | G09G 3/3607 |
| 2017/0116914 | A1* | 4/2017 | Jeong | G09G 3/3225 |
| 2020/0027201 | A1* | 1/2020 | Chen | G06T 19/006 |

FOREIGN PATENT DOCUMENTS

| | | | |
|---|---|---|---|
| CN | 104269138 | A | 1/2015 |
| CN | 108682407 | A | 10/2018 |
| CN | 109817147 | A | 5/2019 |
| JP | 200315070 | A | 1/2003 |
| KR | 10 2009 0014561 | A | 2/2009 |

OTHER PUBLICATIONS

Office Action dated Apr. 17, 2020, issued in counterpart CN Application No. 201910204871.8, with English translation (10 pages).

* cited by examiner

DISPLAY PANEL, DISPLAY METHOD THEREOF, AND DISPLAY APPARATUS

CROSS-REFERENCE TO RELATED APPLICATIONS

This application claims benefit of the filing date of Chinese Patent Application No. 201910204871.8 filed on Mar. 18, 2019, the disclosure of which is hereby incorporated in its entirety by reference.

TECHNICAL FIELD

The present disclosure relates to display technologies, and in particular, to a display panel, a display method, and a display apparatus.

BACKGROUND

White subpixels possess features of high light-emitting efficiency and low power consumption, and have been introduced into the conventional displays to improve brightness, power efficiency, and overall display lifetime.

BRIEF SUMMARY

One embodiment of the present disclosure is a display method of a display panel, wherein the display panel comprises a plurality of pixel units, each of the pixel units comprises a mixed color subpixel and three single color subpixels, and lights emitted by the three single color subpixels are capable of being mixed to produce a light of a mixed color produced by the mixed color subpixel. The display method may include obtaining original luminance of the three single color subpixels in each of the pixel units based on an image to be displayed, calculating luminance of a mixed color produced by the three single color subpixels based on a smallest luminance among the original luminance of the three single color subpixels, and obtaining a first substitute luminance of the mixed color subpixel based on the luminance of the mixed color, and first substitute luminance of the three single color subpixels except for the one having the smallest luminance; obtaining luminance compensation values of the three single color subpixels that need to be color compensated at a time of obtaining the luminance of the mixed color subpixel as the first substitute luminance, based on pre-stored color compensation ratios of the three single color subpixels, so as to obtain luminance of the three single color subpixels after color compensation; calculating luminance of the mixed color produced by the three single color subpixels in the pixel unit respectively based on each of the luminance of the three single color subpixels after color compensation, based on pre-stored ratios of the lights emitted by the three single color subpixels mixed to produce the light of the mixed color emitted by the actual mixed color subpixel, wherein the smallest luminance of the mixed color is denoted by L11, and one of the three single color subpixels which has the smallest luminance of the mixed color is denoted by A1, and the other two of the three single color subpixels are denoted by A2 and A3; and setting input luminance of A1 as 0, and obtaining actual luminance of A2, A3, and the mixed color subpixel based on L11, the pre-stored ratios of the lights emitted by the three single color subpixels mixed to produce the light of the mixed color emitted by the actual mixed color subpixel, the luminance of A2 and A3 after color compensation, and the first substitute luminance of the mixed color subpixel, and performing data input.

Optionally, the display method, before calculating the luminance of the mixed color produced by the three single color subpixels, further comprises obtaining chromaticity coordinates of the three single color subpixels and the mixed color subpixel in the display panel at given output luminance; calculating ratios of the lights produced by the three single color subpixels mixed to produce the light of the mixed color emitted by the target mixed color subpixel, which are denoted by RatioAX1, RatioAX2, And RatioAX3 respectively, through a color mixing formula and based on chromaticity coordinate of a target mixed color subpixel; calculating ratios of the lights produced by the three single color subpixels mixed to produce the light of the mixed color emitted by the actual mixed color subpixel, which are denoted by RatioBX1, RatioBX2, And RatioBX3 respectively, based on the chromaticity coordinates of the three single color subpixels and the chromaticity coordinate of the mixed color subpixel; calculating the color compensation ratios of the three single color subpixels, which are denoted by gainX1, gainX2, and gainX3 respectively, based on RatioAX1, RatioAX2, RatioAX3, RatioBX1, RatioBX2, and RatioBX3; and storing RatioBX1, RatioBX2, RatioBX3, gainX1, gainX2, and gainX3.

Optionally, calculating luminance of the mixed color produced by the three single color subpixels in the pixel unit respectively based on each of the luminance of the three single color subpixels after color compensation further comprises calculating the luminance of the mixed color produced by the three single color subpixels according to the following formulas:

$$L_{11}=L_1/\mathrm{Ratio}BX1,$$

$$L_{12}=L2/\mathrm{Ratio}BX2,$$

$$L_{13}=L3/\mathrm{Ratio}BX3,$$

where $L_{11}$, $L_{12}$, and $L_{13}$ are the luminance of the mixed color produced by A1, A2, and A3 based on each of the luminance of A1, A2, and A3 after color compensation, respectively.

Optionally, setting input luminance of A1 as 0, and obtaining actual luminance of A2, A3, and the mixed color subpixel based on L11, the pre-stored ratios of the lights emitted by the three single color subpixels mixed to produce the light of the mixed color emitted by the actual mixed color subpixel, the luminance of A2 and A3 after color compensation, and the first substitute luminance of the mixed color subpixel, and performing data input comprises setting the input luminance of A1 as 0, and calculating and storing the actual luminance of A2, A3, and the mixed color subpixel according to the following formulas:

$$L_{10'}=L_{11}+L_{10}$$

$$L_{12'}=L_{12}-L_{11}/\mathrm{Ratio}BX2$$

$$L_{13'}=L_{13}-L_{11}/\mathrm{Ratio}BX3$$

where $L_{10}$ represents the first substitute luminance of the mixed color subpixel, $L_{10'}$ represents the actual luminance of the mixed color subpixel, $L_{12'}$ represents the actual luminance of A2, and $L_{13'}$ is the actual luminance of A3.

Optionally, at most three subpixels among the mixed color subpixel and the three single color subpixels in each of the pixel units illuminate at the same time for display.

Optionally, the three single color subpixels in each of the pixel units comprise a red subpixel, a green subpixel, and a blue subpixel, and the mixed color subpixel comprises a white subpixel.

Another embodiment of the present disclosure is a display panel. The display panel may comprise a plurality of pixel units, wherein each of the pixel units comprises a mixed color subpixel and three single color subpixels, and lights emitted by the three single color subpixels are capable of being mixed to produce a light of a mixed color produced by the mixed color subpixel; a first calculating processor configured to obtain original luminance of the three single color subpixels in each of the pixel units based on an image to be displayed, calculate luminance of a mixed color produced by the three single color subpixels based on the smallest luminance among the original luminance the three single color subpixels, and obtain first substitute luminance of the mixed color subpixel based on the luminance of the mixed color, and first substitute luminance of the three single color subpixels except for the one having the smallest luminance; a second calculating processor, configured to obtain luminance compensation values of the three single color subpixels that need to be color compensated at a time of obtaining the luminance of the mixed color subpixel as the first substitute luminance, based on pre-stored color compensation ratios of the three single color subpixels, so as to obtain luminance of the three single color subpixels after color compensation; a third calculating processor, configured to calculate luminance of the mixed color produced by the three single color subpixels in the pixel unit based on each of the luminance of the three single color subpixels after color compensation respectively, based on pre-stored ratios of the lights emitted by the three single color subpixels mixed to produce the light of the mixed color emitted by the actual mixed color subpixel, wherein the smallest luminance of the mixed color is denoted by L11, and one of the three single color subpixels which has the smallest luminance of the mixed color is denoted by A1, and the other two of the three single color subpixels are denoted by A2 and A3; and a data writing processor, configured to set input luminance of A1 as 0, and obtain actual luminance of A2, A3, and the mixed color subpixel based on L11, the pre-stored ratios of the lights emitted by the three single color subpixels mixed to produce the light of the mixed color emitted by the actual mixed color subpixel, the luminance of A2 and A3 after color compensation, and the first substitute luminance of the mixed color subpixel, and perform data input.

Optionally, the display panel further comprises an acquisition processor, configured to obtain chromaticity coordinates of the three single color subpixels and the mixed color subpixel in the display panel at given output luminance; a fourth calculating processor, configured to calculate ratios of the lights produced by the three single color subpixels mixed to produce the light of the mixed color emitted by the target mixed color subpixel, which are denoted by RatioAX1, RatioAX2, And RatioAX3 respectively, through a color mixing formula and based on chromaticity coordinate of a target mixed color subpixel; calculate ratios of the lights produced by the three single color subpixels mixed to produce the light of the mixed color emitted by the actual mixed color subpixel, which are denoted by RatioBX1, RatioBX2, And RatioBX3 respectively, based on the chromaticity coordinates of the three single color subpixels and the chromaticity coordinate of the mixed color subpixel; and calculate the color compensation ratios of the three single color subpixels, which are denoted by gainX1, gainX2, and gainX3 respectively, based on RatioAX1, RatioAX2, RatioAX3, RatioBX1, RatioBX2, and RatioBX3; and a storage processor, configured to store RatioBX1, RatioBX2, RatioBX3, gainX1, gainX2, and gainX3.

Optionally, the third calculating processor is configured to calculate the luminance of the mixed color produced by the three single color subpixels in the pixel unit respectively based on each of the luminance of the three single color subpixels after color compensation according to the following formulas:

$$L_{11}=L_1/\text{Ratio}BX1$$

$$L_{12}=L2/\text{Ratio}BX2$$

$$L_{13}=L3/\text{Ratio}BX3$$

where $L_{11}$, $L_{12}$, and $L_{13}$ are the luminance of the mixed color produced by A1, A2, and A3 based on each of the luminance of A1, A2, and A3 after color compensation, respectively.

Optionally, the data writing processor is configured to setting input luminance of A1 as 0, and calculate and store the actual luminance of A2, A3, and the mixed color subpixel according to the following formulas:

$$L_{10'}=L_{11}+L_{10}$$

$$L_{12'}=L_{12}-L_{11}/\text{Ratio}BX2$$

$$L_{13'}=L_{13}-L_{11}/\text{Ratio}BX3$$

where $L_{10}$ represents the first substitute luminance of the mixed color subpixel, $L_{10'}$ represents the actual luminance of the mixed color subpixel, $L_{12'}$ represents the actual luminance of A2, and $L_{13'}$ is the actual luminance of A3.

Optionally, the three single color subpixels in each of the pixel units comprise a red subpixel, a green subpixel, and a blue subpixel; and the mixed color subpixel comprises a white subpixel.

Optionally, at most three subpixels among the mixed color subpixel and the three single color subpixels in each of the pixel units illuminate at the same time for display.

One embodiment of the present disclosure is a display apparatus, comprising the display panel according to one embodiment of the present disclosure.

One embodiment of the present disclosure is a computer readable storage medium having stored thereon computer program instructions, wherein when the computer program instructions are executed by a processor, a display method of a display panel is implemented, wherein the display panel comprises a plurality of pixel units, each of the pixel units comprises a mixed color subpixel and three single color subpixels, and lights emitted by the three single color subpixels are capable of being mixed to produce a light of a mixed color produced by the mixed color subpixel, the display method comprising obtaining original luminance of the three single color subpixels in each of the pixel units based on an image to be displayed, calculating luminance of a mixed color produced by the three single color subpixels based on a smallest luminance among the original luminance of the three single color subpixels, and obtaining a first substitute luminance of the mixed color subpixel based on the luminance of the mixed color, and first substitute luminance of the three single color subpixels except for the one having the smallest luminance; obtaining luminance compensation values of the three single color subpixels that need to be color compensated at a time of obtaining the luminance of the mixed color subpixel as the first substitute luminance, based on pre-stored color compensation ratios of the three single color subpixels, so as to obtain luminance of the three single color subpixels after color compensation; calculating luminance of the mixed color produced by the three single color subpixels in the pixel unit respectively based on each of the luminance of the three single color subpixels after color compensation, based on pre-stored ratios of the lights emitted by the three single color subpixels mixed to produce the light of the mixed color emitted by the actual mixed color subpixel, wherein the smallest luminance of the mixed color is denoted by L11, and one of the three single color subpixels which has the smallest luminance of the mixed color is denoted by A1, and the other two of the three single color subpixels are denoted by A2 and A3; and setting input luminance of A1 as 0, and obtaining actual luminance of A2, A3, and the mixed color subpixel based on L11, the pre-stored ratios of the lights emitted by the three single color subpixels mixed to produce the light of the mixed color emitted by the actual mixed color subpixel, the luminance of A2 and A3 after color compensation, and the first substitute luminance of the mixed color subpixel, and performing data input.

Optionally, the computer readable storage medium, before calculating the luminance of the mixed color produced by the three single color subpixels, further comprises obtaining chromaticity coordinates of the three single color subpixels and the mixed color subpixel in the display panel at given output luminance; calculating ratios of the lights produced by the three single color subpixels mixed to produce the light of the mixed color emitted by the target mixed color subpixel, which are denoted by RatioAX1, RatioAX2, And RatioAX3 respectively, through a color mixing formula and based on chromaticity coordinate of a target mixed color subpixel; calculating ratios of the lights produced by the three single color subpixels mixed to produce the light of the mixed color emitted by the actual mixed color subpixel, which are denoted by RatioBX1, RatioBX2, And RatioBX3 respectively, based on the chromaticity coordinates of the three single color subpixels and the chromaticity coordinate of the mixed color subpixel; calculating the color compensation ratios of the three single color subpixels, which are denoted by gainX1, gainX2, and gainX3 respectively, based on RatioAX1, RatioAX2, RatioAX3, RatioBX1, RatioBX2, and RatioBX3; and storing RatioBX1, RatioBX2, RatioBX3, gainX1, gainX2, and gainX3.

Optionally, calculating luminance of the mixed color produced by the three single color subpixels in the pixel unit respectively based on each of the luminance of the three single color subpixels after color compensation further comprises calculating the luminance of the mixed color produced by the three single color subpixels according to the following formulas:

$$L_{11}=L_1/\mathrm{Ratio}BX1,$$

$$L_{12}=L2/\mathrm{Ratio}BX2,$$

$$L_{13}=L3/\mathrm{Ratio}BX3,$$

where $L_{11}$, $L_{12}$, and $L_{13}$ are the luminance of the mixed color produced by A1, A2, and A3 based on each of the luminance of A1, A2, and A3 after color compensation, respectively.

Optionally, setting input luminance of A1 as 0, and obtaining actual luminance of A2, A3, and the mixed color subpixel based on L11, the pre-stored ratios of the lights emitted by the three single color subpixels mixed to produce the light of the mixed color emitted by the actual mixed color subpixel, the luminance of A2 and A3 after color compensation, and the first substitute luminance of the mixed color subpixel, and performing data input comprises setting the input luminance of A1 as 0, and calculating and storing the actual luminance of A2, A3, and the mixed color subpixel according to the following formulas:

$$L_{10'}=L_{11}+L_{10}$$

$$L_{12'}=L_{12}-L_{11}/\mathrm{Ratio}BX2$$

$$L_{13'}=L_{13}-L_{11}/\mathrm{Ratio}BX3$$

where $L_{10}$ represents the first substitute luminance of the mixed color subpixel, $L_{10'}$ represents the actual luminance of the mixed color subpixel. $L_{12'}$ represents the actual luminance of A2, and $L_{13'}$ is the actual luminance of A3.

Optionally, the white subpixel and only two of the three single color subpixels illuminate to produce a color based on the original luminance of the three single color subpixels in each of the pixel units.

Optionally, the three single color subpixels in each of the pixel units comprise a red subpixel, a green subpixel, and a blue subpixel, and the mixed color subpixel comprises a white subpixel.

Optionally, at most three subpixels among the mixed color subpixel and the three single color subpixels in each of the pixel units illuminate at the same time for display.

BRIEF DESCRIPTION OF THE DRAWINGS

The drawings are intended to provide a further understanding of the technical solutions of the present disclosure, and are intended to be a part of the specification, and are used to explain the technical solutions of the present disclosure, and do not constitute a limitation of the technical solutions of the present disclosure.

DETAILED DESCRIPTION

Figure 1:
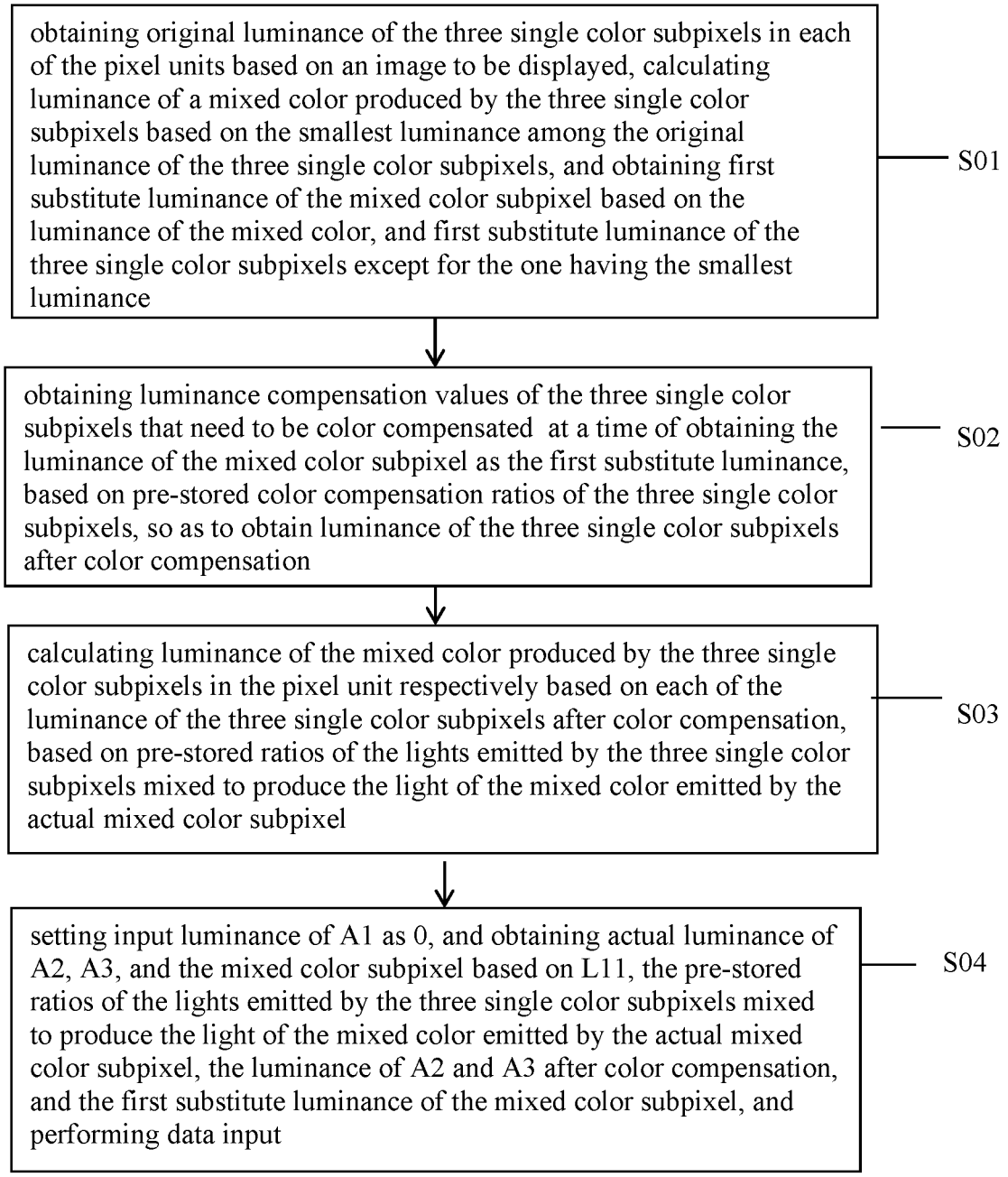
FIG. 1 is a flow chart showing a display method of a display panel according to one embodiment of the present disclosure.

The present disclosure will be further described in detail with reference to the accompanying drawings. When referring to the figures, like structures and elements shown throughout are indicated with like reference numerals. Obviously, the described embodiments are only a part of the embodiments of the present disclosure, not all of the embodiments. All other embodiments obtained by a person of ordinary skill in the art based on the embodiments of the present disclosure without creative efforts are within the protection scope of the present disclosure. In the description of the following embodiments, specific features, structures, materials or characteristics may be combined in any suitable manner in any one or more embodiments or examples.

Moreover, the terms "first" and "second" are used for descriptive purposes only and are not to be construed as indicating or implying a relative importance or implicitly indicating the number of technical features indicated. Thus, features defining "first" or "second" may include at least one of the features, either explicitly or implicitly. In the description of the present disclosure, the meaning of "a plurality" is at least two, such as two, three, etc., unless specifically defined otherwise.

In the description of the present specification, the description with reference to the terms "one embodiment", "some embodiments", "example", "specific example", or "some examples" and the like means a specific feature described in connection with the embodiment or example. A structure, material or feature is included in at least one embodiment or example of the disclosure. In the present specification, the schematic representation of the above terms is not necessarily directed to the same embodiment or example. Furthermore, the particular features, structures, materials, or characteristics described may be combined in a suitable manner in any one or more embodiments or examples. In addition, those skilled in the art can combine and combine the different embodiments or examples described in the specification and the features of different embodiments or examples, without contradicting each other.

In order to improve the display life of the OLED, white sub-pixels are added to the pixels of the OLED, and a replacement algorithm of replacing red, green and blue subpixels with white subpixels is added. The white subpixels may possess features of high light-emitting efficiency and low power consumption, which improve brightness, power efficiency, and overall display lifetime.

In the prior art, RGB are replaced by W, and at most 2 of RGB illuminate, and the remaining brightness is provided by W, wherein W represents a white sub-pixel, R, G, B represents a red, green, blue sub-pixel respectively. At present, the W sub-pixel of OLED has a color shift problem. According to the color mixing principle, two colors are required for chromaticity compensation. In an ideal case, in the W display state, W and complementary color sub-pixels will be illuminated. So a total of three sub-pixels are illuminated. If there is a non-complementary color to participate in the actual display, four sub-pixels will be illuminated at the same time. Therefore, power consumption of the display panel is still very high.

One embodiment of the present disclosure provides a display method of a display panel. The display panel includes a plurality of pixel units, and each of the pixel units includes one mixed color subpixel and three single color subpixels. The light emitted from the three single color subpixels can be mixed to produce a light of a mixed color emitted from the mixed color subpixel. As shown in FIG. 1, the display method includes:

Step S01: acquiring original luminance of the three single color subpixels in each of the pixel units based on an image to be displayed, and calculating luminance of a mixed color produced by the three single color subpixels of each of the pixel units based on the smallest original luminance of the three single color subpixels; obtaining first substitute luminance of the mixed color subpixel, denoted by $L_{10}$, based on the luminance of the mixed color; and obtaining first substitute luminance of the other two of the three single color subpixels except the one having the smallest luminance.

In one embodiment, the three single color subpixels in each pixel unit are respectively represented by A1, A2, and A3. If the original luminance of A1 in the three single color subpixels is the smallest, the luminance of the mixed color produced by the three single color subpixels is calculated based on the original luminance of A1. Then, based on the calculated luminance of the mixed color and the original luminance of the mixed color subpixel (optionally, the sum of the luminance of the two), the first substitute luminance of the mixed color subpixel can be obtained, denoted by $L_{10}$. Meanwhile, the first substitute luminance of A2 and A3 can be obtained, denoted by $L_{20}$ and $L_{30}$ respectively, using the calculated luminance of the mixed color based on the original luminance of A1 (the calculated luminance of the mixed color includes the original luminance of A1 and corresponding luminance of A2 and A3). It should be noted that $L_{20}$ is the corresponding luminance provided by A2 in the luminance of the mixed color calculated based on the original luminance of A2 minus the original luminance of A1, and $L_{30}$ is the corresponding luminance provided by A3 in the luminance of the mixed color calculated based on the original luminance of A3 minus the original luminance of A1.

Step S02: obtaining the luminance compensation values of the three single color subpixels that need to be color compensated at the time of obtaining the luminance of the mixed color subpixel as the first substitute luminance $L_{10}$, based on the pre-stored color compensation ratios of the three single color subpixels.

Because the color compensation ratios of the three single color subpixels are required in this step, the step for obtaining the color compensation ratios of the three single color subpixels may be included before the step S02. Optionally, they can be obtained by the following method:

obtaining chromaticity coordinates of the three single color subpixels and the mixed color subpixel of a display panel respectively at a given output luminance;

calculating the ratios of the lights produced by the three single color subpixels mixed to produce the light of the mixed color emitted by a target mixed color subpixel, denoted by RatioAX1, RatioAX2, And RatioAX3 respectively, through the color mixing formula and based on the chromaticity coordinate of the target mixed color subpixel;

calculating the ratios of the lights produced by the three single color subpixels mixed to produce the light of the mixed color emitted by the actual mixed color subpixel, denoted by RatioBX1, RatioBX2, And RatioBX3 respectively, based on the obtained chromaticity coordinates of the three single color subpixels and the chromaticity coordinate of the mixed color subpixel:

calculating the color compensation ratios of the three single color subpixels, denoted by gainX1, gainX2, and gainX3 respectively, based on RatioAX1, RatioAX2, RatioAX3, RatioBX1, RatioBX2, and RatioBX3; and storing values of RatioBX1, RatioBX2, RatioBX3, gainX1, gainX2, and gainX3.

Step S03: based on the pre-stored ratios of the lights produced by the three single color subpixels mixed to produce the light of the mixed color emitted by the actual mixed color subpixel, calculating the luminance of the mixed colors produced by the three single color subpixels in the pixel unit based on each of the luminance of the single color subpixels after color compensation respectively. The smallest luminance of the mixed color is denoted by $L_{11}$. The single color subpixel, based on which the calculated luminance of the mixed color is the smallest, is denoted by A1, and the other two are denoted by A2 and A3.

Optionally, if the ratios of the color produced by A1, A2, and A3 mixed to produce the mixed color emitted by the actual mixed color subpixel are RatioBX1, RatioBX2, and RatioBX3 respectively, and the luminance of A1, A2, and A3 after color compensation are $L_1$, $L_2$, and $L_3$ respectively, the step includes:

Calculating the luminance of the mixed color produced by the three single color subpixels in the pixel unit, according to the following formula:

$$L_{11}=L_1/\text{Ratio}BX1;$$

$$L_{12}=L_2/\text{Ratio}BX2;$$

$$L_{13}=L_3/\text{Ratio}BX3;$$

where $L_{11}$, $L_{12}$, and $L_{13}$ are the luminance of the mixed colors produced by A1, A2, and A3 based on each of the luminance of A1, A2, and A3 after color compensation respectively.

Step S04: setting the luminance of A1 as 0, and obtaining the actual luminance of A2, A3, and the mixed color subpixel based on $L_{11}$, the pre-stored ratios of the lights produced by the three single color subpixels mixed to produce a light of the mixed color emitted by the actual mixed color subpixel, the luminance of A2 and A3 after color compensation, and the first substitute luminance of the mixed color subpixel, and performing data input of the actual luminance of A2, A3, and the mixed color subpixel.

Optionally, the step can be done by the following steps:

Set the input luminance of A1 as 0, and calculate the actual luminance of A2, A3, and the mixed color subpixel using the following formula:

$$L_{10'}=L_{11}+L_{10};$$

$$L_{12'}=L_{12}-L_{11}/\text{Ratio}BX2;$$

$$L_{13'}=L_{13}-L_{11}/\text{Ratio}BX3;$$

where $L_{10'}$ is the actual luminance of the mixed color subpixel. $L_{12'}$ is the actual luminance of A2, and $L_{13'}$ is the actual luminance of A3. Because only three of the four subpixels in each pixel unit may need to illuminate according to some embodiments of the present disclosure, the method described above can significantly reduce the power consumption of the display panel.

Figure 2:
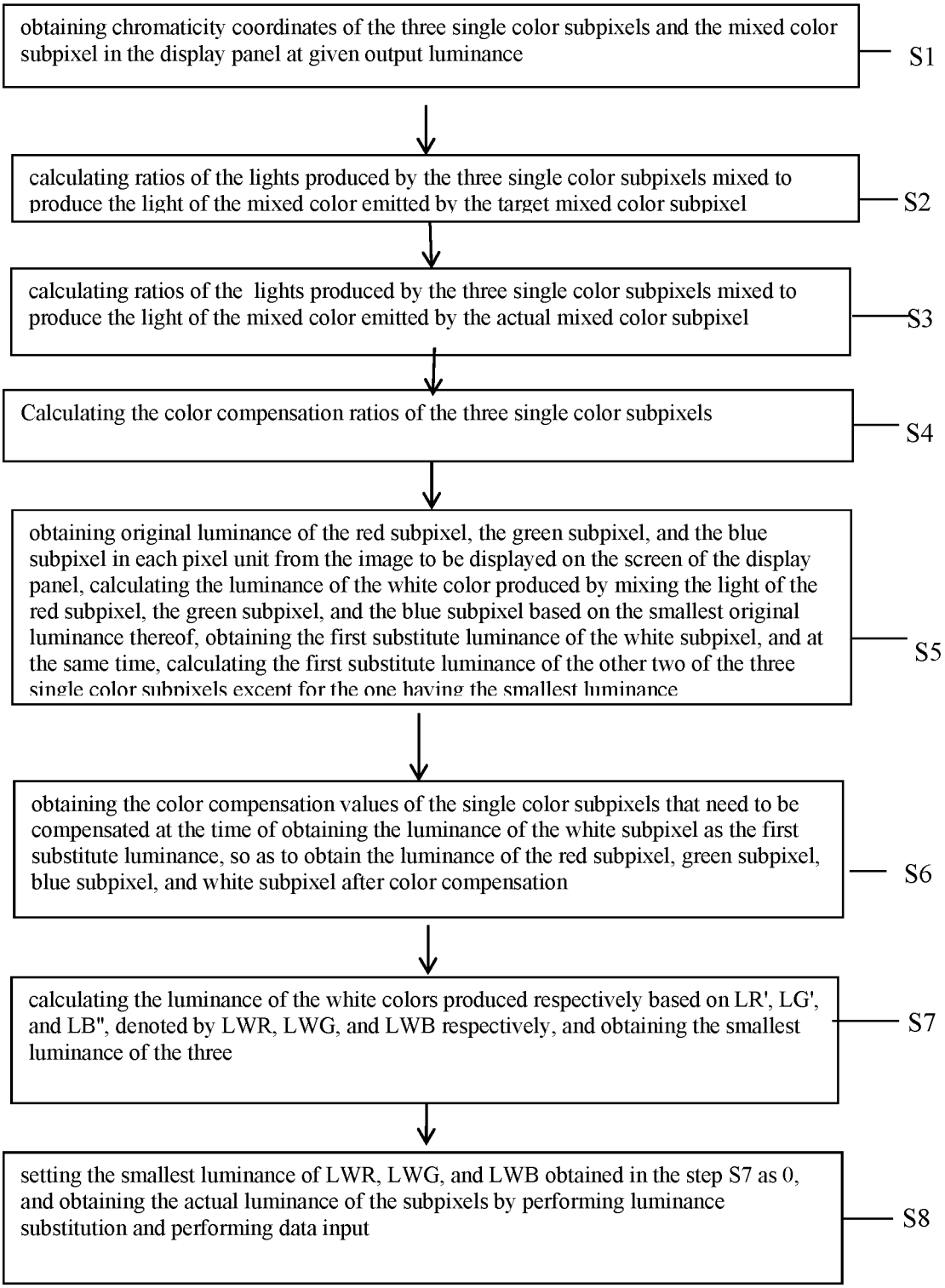
FIG. 2 is a flow chart showing a display method of a display panel according to one embodiment of the present disclosure.

To better understand the display method in some embodiments of the present disclosure, the three single color subpixels in each pixel unit may be red subpixel, green subpixel, and blue subpixel, and the mixed color subpixel may be a white subpixel. The display method will be further described in the following embodiments:

As shown in FIG. 2, one embodiment of the present disclosure provides a display method of a display panel. The display method includes the following steps:

Step S1: measuring the actual chromaticity coordinates of the red subpixel, the green subpixel, the blue subpixel, and the white subpixel in the display panel at given output luminance, respectively, denoted by R(x, y), G(x, y), B(x, y), W(x, y).

Step S2: calculating the ratios of the red subpixel, the green subpixel, and the blue subpixel mixed to produce a target white color and the ratios of those mixed to produce an actual white color based on the chromaticity coordinates obtained in the step one S1 and the color mixing formula. The ratios of the red subpixel, the green subpixel, and the blue subpixel mixed to produce the target white color are denoted by RatioAR, RatioAG, and RatioAB, respectively. The ratios of the red subpixel, the green subpixel, and the blue subpixel mixed to produce the actual white color are denoted by RatioBR, RatioBG, and RatioBB, respectively.

Step S3: calculating the color compensation ratios of the red subpixel, the green subpixel, and the blue subpixel, denoted by gainR, gainG, and gainB respectively, based on the calculated ratios of the red subpixel, the green subpixel, and the blue subpixel mixed to produce the target white color, and the calculated ratios of those mixed to produce the actual white color in step S2.

Step four S4: storing the ratios of the red subpixel, the green subpixel, and the blue subpixel mixed to produce an actual white color, RatioBR, RatioBG, and RatioBB calculated in the step two S2 and the color compensation ratios, gainR, gainG, and gainB, calculated in the step three S3. The ratios may be written into a storage memory.

Step S5: obtaining original luminance of the red subpixel, the green subpixel, and the blue subpixel in each pixel unit from the image to be displayed on the screen of the display panel, calculating the luminance of the white color produced by mixing the light of the red subpixel, the green subpixel, and the blue subpixel in each pixel unit based on the smallest original luminance thereof, obtaining the first substitute luminance of the white subpixel by adding the calculated luminance of the white color to the original luminance of the white color, and at the same time, calculating the first substitute luminance of the other two of the three single color subpixels except for the one having the smallest luminance.

In one embodiment, the red subpixel in one of the pixel units has the smallest original luminance. The original luminance of the red subpixel, the green subpixel, and blue subpixel are denoted by LR, LG, and LB respectively, and the luminance of the mixed white color produced based on LR in combination with the green subpixel and the blue subpixel is denoted by LW. LW is added to the original luminance of the white subpixel to obtain the first substitute luminance LW' of the white subpixel. Subtracting the part of luminance contributed by the green subpixel in the white color based on LR from LG can obtain the remaining luminance, that is, first substitute luminance of the green subpixel, denoted by LG'. Likewise, subtracting the part of luminance contributed by the blue subpixel in the white color based on LR from LB can obtain the remaining luminance, that is, first substitute luminance of the blue subpixel, denoted by LB'.

Step S6: based on the stored color compensation ratios of the red subpixel, green subpixel, and blue subpixel, gainR, gainG, and gainB, in the step four S4, obtaining the color compensation values of the single color subpixels that need to be compensated at the time of obtaining the luminance of the white subpixel as the first substitute luminance, so as to obtain the luminance of the red subpixel, green subpixel, blue subpixel, and white subpixel after color compensation.

In one embodiment, on the basis of the step S5, the red subpixel has the smallest original luminance LR, LW is the luminance of the white color produced based on LR. In the step six S6, it is calculated that the red subpixel and blue subpixel are the color subpixels that require color compensation. The compensation values of the red and blue subpixels are calculated according to the color compensation ratios. Then, the compensation value and the first substitute luminance of the red subpixel are added to obtain the luminance of the red subpixel LR' after color compensation, and the compensation value and the first substitute luminance of the blue subpixel are added to obtain the luminance of the blue subpixel LB" after color compensation. After this step, the luminance of the red subpixel, the green subpixel, the blue subpixel, and the white subpixel are LR', LG', LB", and LW', respectively.

Step seven S7: based on the luminance of the red, green, and blue subpixels after compensation, LR', LG', and LB" calculated in the step six S6, and the ratios of RatioBR, RatioBG, and RatioBB stored in the step four S4, calculating the luminance of the white colors produced respectively based on LR', LG', and LB", denoted by LWR, LWG, and LWB respectively, and obtaining the smallest uninane of the three.

In one embodiment, LWR is the smallest, LWR=LR'/RatioBR, LWG=LG'/RatioBG, and LWB=LB"/LWB.

Step S8: setting the smallest luminance of LWR, LWG, and LWB obtained in the step S7 as 0, and obtaining the actual luminance of the subpixels by performing luminance substitution based on the luminance of the other subpixels after color compensation and the ratios, RatioBR, RatioBG, and RatioBB, obtained in the step four S4, and performing data input.

Optionally, on the basis of the step S7, LWR is the smallest, and the luminance of the red subpixel is set to be 0. The second substitutions are performed to the luminance of the white subpixel, the green subpixel, and the blue subpixel according to the following formula: W=LWR+LW', G=LG'−LWR×RatioBG, and B=LB"−LWR×RatioBB, where W, G, and B are the actual luminance of the white subpixel, the green subpixel, and the blue subpixel, respectively. Thus, the actual luminance values of the white subpixel, the green subpixel, and the blue subpixel are calculated, and the data will be input into the corresponding pixels of the display panel for display.

In some embodiments of the present disclosure, only three subpixels out of the four subpixels may need to illuminate in each pixel unit, thereby greatly reducing the power consumption of the display panel, and also achieving good display effect.

Figure 3:
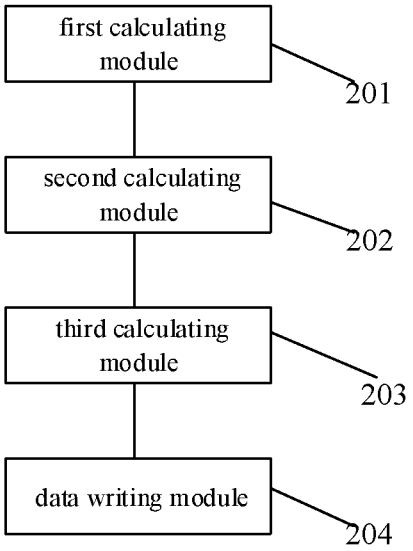
FIG. 3 is a schematic diagram of a display panel according to one embodiment of the present disclosure.

As shown in FIG. 3, another embodiment of the present disclosure provides a display panel using the display method as described above. The display panel includes a plurality of pixel units. Each of the pixel units includes a mixed color subpixel and three single color subpixels, where the light of the three single color subpixels can be mixed to produce a light produced by the mixed color subpixel. The display panel further includes a first computing processor 201, a second computing processor 202, a third computing processor 203, and a data writing processor 204.

The first computing processor 201 is configured to acquire original luminance of three single color subpixels in each pixel unit based on the image to be displayed, and calculate the luminance of the mixed color produced by the three single color subpixels based on the lowest original luminance of the three single color subpixels, and obtain the first substitute luminance of the mixed color subpixel based on the luminance of the mixed color, and also obtain the first substitute luminance of the other two of the three single color subpixels except for the one having the lowest luminance.

The second computing processor 202 is configured to, based on the pe-stored color compensation ratios of the three single color subpixels, obtain the luminance compensation values of the three single color subpixels that need to be compensated at the time of obtaining the luminance of the mixed color subpixel as the first substitute luminance so as to obtain the luminance of the three single color subpixels after color compensation.

The third computing processor 203 is configured to, based on the pre-stored ratios of the lights produced by the three single color subpixels mixed to produce the mixed color emitted by the actual mixed color subpixel, calculate the luminance of the mixed color produced by the three single color subpixels in the pixel unit based on the luminance of each single color subpixel after color compensation respectively. The smallest luminance of the mixed colors is denoted by $L_{11}$. The single color subpixel, based on which the calculated luminance of the mixed color is the smallest, is denoted by A1, and the other two are denoted by A2 and A3.

The data writing processor 204 is configured to set the input luminance of A1 as 0, and obtain the actual luminance of A2, A3, and the mixed color subpixel, based on $L_{11}$, the pre-stored ratios of the lights produced by the three single color subpixels mixed to produce the light of the mixed color produced by the mixed color subpixel, the luminance of A2 and A3 after color compensation, and the first substitute luminance of the mixed color subpixel, and perform data input.

Figure 4:
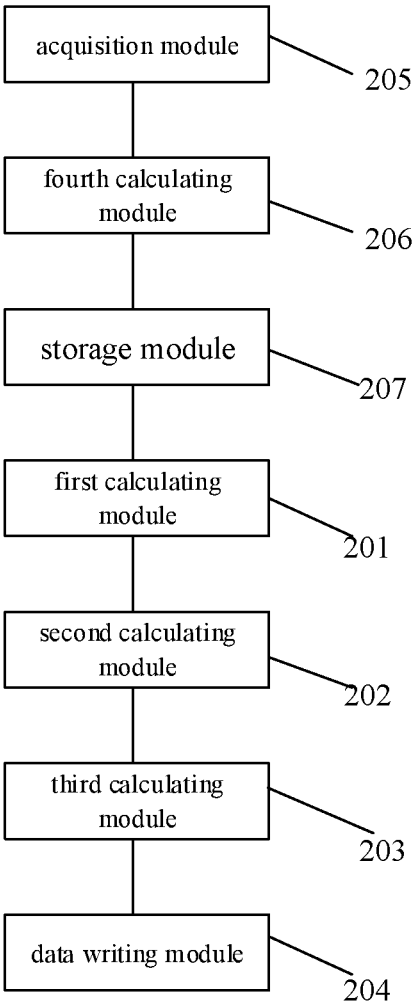
FIG. 4 is a schematic diagram of a display panel according to one embodiment of the present disclosure.

In one embodiment, as shown in FIG. 4, the display panel further includes an acquisition processor 205, a fourth computing processor 206, and a storage processor 207.

Optionally, the acquisition processor 205 is configured to obtain chromaticity coordinates of the three single color subpixels and the mixed color subpixel at given output luminance.

The fourth calculating processor 206 is configured to calculate the ratios of the lights produced by the three single color subpixels mixed to produce a light of the mixed color emitted by the target mixed color subpixel, denoted by RatioAX1, RatioAX2, And RatioAX3 respectively, through the color mixing formula and based on the chromaticity coordinate of the target mixed color subpixel; calculate the ratios of the lights produced by the three single color subpixels mixed to produce the light of the mixed color emitted by the actual mixed color subpixel, denoted by RatioBX1, RatioBX2, And RatioBX3 respectively, based on the obtained chromaticity coordinates of the three single color subpixels and the chromaticity coordinate of the mixed color subpixel; and calculate the color compensation ratios of the three single color subpixels, denoted by gainX1, gainX2, and gainX3 respectively, based on RatioAX1, RatioAX2, RatioAX3, RatioBX1, RatioBX2, and RatioBX3.

The storage processor 207 is configured to store RatioBX1, ratioBX2, ratioBX3, gainX1, gainX2, and gainX3.

If the ratios of the lights produced by A1, A2, and A3 mixed to produce the light of the mixed color emitted by the actual mixed color subpixel are RatioBX1, RatioBX2, and RatioBX3, the luminance of A1, A2, and A3 after color compensation is L1, L2, L3, respectively.

The third computing processor 203 is configured to calculate the luminance of the mixed color produced by the three single color subpixels in the pixel units according to the following formula:

$$L_{11}=L1/\text{Ratio}BX1;$$

$$L_{12}=L2/\text{Ratio}BX2;$$

$$L_{13}=L3/\text{Ratio}BX3;$$

where $L_{11}$, $L_{12}$, and $L_{13}$ are the luminance of the mixed colors that can be produced by A1, A2, and A3 based on the luminance of A1, A2, and A3 after compensation, respectively.

In one embodiment, the first substitute luminance of the mixed color subpixel is $L_{10}$, the data writing processor 204 is configured to set the input luminance of A1 to be 0, calculate the actual luminance of A2, A3, and the mixed color subpixel by using the following formulas, and then input the data;

$$L_{10'}=L_{11}+L_{10};$$

$L_{12'}=L_{12}-L_{11}/\text{Ratio}BX2$;

$L_{13'}=L_{13}-L_{11}/\text{Ratio}BX3$;

where $L_{10'}$ is the actual luminance of the mixed color subpixel, $L_{12'}$ is the actual luminance of A2, and $L_{13'}$ is the actual luminance of A3.

The first computing processor 201, the second computing processor 202, the third computing processor 203, and the data writing processor 204, the acquisition processor 205, the fourth computing processor 206 each may include a central processing unit (CPU), or an application specific integrated circuit (ASIC), or may be configured to implement one or more integrated circuits in some embodiments of the present disclosure.

The storage processor 207 may include mass storage for data or computational instructions. Optionally, the storage processor 207 may include a hard disk drive (HDD), a floppy disk drive, a flash memory, an optical disk, a magneto-optical disk, a magnetic tape, or a universal serial bus (USB) drive, or a combination of two or more of these. The storage processor 207 may include removable or non-removable (or fixed) media. The storage processor 207 may also include internal or external data processing devices. Optionally, the storage processor 207 may include a non-volatile solid-state memory. The storage processor 207 may include a read only memory (ROM), where the ROM may be a mask programmed ROM, a programmable ROM (PROM), an erasable PROM (EPROM), an electrically erasable PROM (EEPROM), an electrically rewritable ROM (EAROM) or flash memory or a combination of two or more of these.

In some embodiments of the present disclosure, the three single color subpixels in each pixel unit include a red subpixel, a green subpixel, and a blue subpixel, and the mixed color subpixel includes a white subpixel. Because the display panel according to some embodiments of the present disclosure only needs to illuminate three of the four subpixels in each pixel unit for display, the power consumption can be greatly reduced.

Another embodiment of the disclosure provides a display apparatus, wherein the display method may be implemented by the display apparatus. In some embodiments, the display apparatus may include may include a processor 401 and a memory 402 storing computer program instructions.

In one embodiment, the processor 401 may include a central processing unit (CPU), or an application specific integrated circuit (ASIC), or may be configured to implement one or more integrated circuits of the embodiments of the present invention.

Memory 402 may include mass storage for data or instructions. By way of example and not limitation, the memory 402 can include a Hard Disk Drive (HDD), a floppy disk drive, a flash memory, an optical disk, a magneto-optical disk, a magnetic tape, or a Universal Serial Bus (USB) drive, or combination of two or more thereof. Memory 402 may include removable or non-removable (or fixed) media, where appropriate. Memory 402 may be internal or external to the data processing device, where appropriate. In a particular embodiment, memory 402 is a non-volatile solid state memory. In a particular embodiment, memory 402 includes a read only memory (ROM). Where appropriate, the ROM may be a mask programmed ROM, a programmable ROM (PROM), an erasable PROM (EPROM), an electrically erasable PROM (EEPROM), an electrically rewritable ROM (EAROM) or flash memory or combination of two or more thereof.

The processor 401 implements the display method of any one of the embodiments of the present disclosure by reading and executing the computer program instructions stored in the memory 402.

Figure 5:
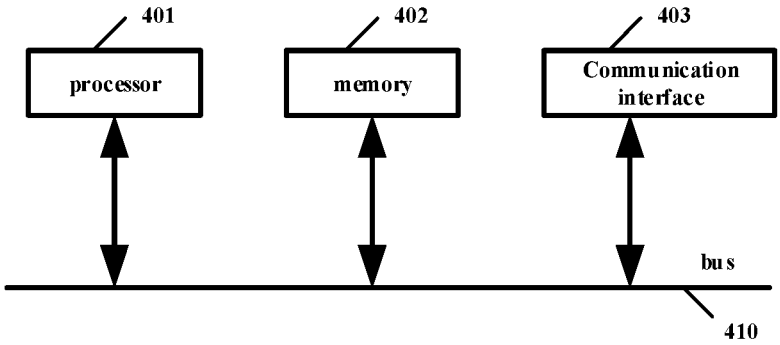
FIG. 5 is a schematic diagram of a display apparatus according to one embodiment of the present disclosure

In one embodiment, the display apparatus may also include a communication interface 403 and a bus 410. Wherein, as shown in FIG. 5, the processor 401, the memory 402, and the communication interface 403 are connected through the bus 410 and complete communication with each other.

The communication interface 403 is mainly used to implement communication between modules, devices, units and/or devices in the embodiments of the present invention.

The bus 410 may include hardware, software, or both, and couples components of the display apparatus to each other. By way of example and not limitation, the bus may include an accelerated graphics port (AGP) or other graphics bus, an enhanced industry standard architecture (EISA) bus, a front side bus (FSB), a super transfer (HT) interconnect, an industry standard architecture (ISA). Bus, Infinite Bandwidth Interconnect, Low Pin Count (LPC) Bus, Memory Bus, Micro Channel Architecture (MCA) Bus, Peripheral Component Interconnect (PCI) Bus, PCI-Express (PCI-X) Bus, Serial Advanced Technology Attachment (SATA) bus, Video Electronics Standards Association Local (VLB) bus or other suitable bus or a combination of two or more of these. Bus 410 may include one or more buses, where appropriate. Although embodiments of the present disclosure describe and illustrate a particular bus, the present disclosure contemplates any suitable bus or interconnection.

Some embodiments of the present invention may be implemented by providing a computer readable storage medium. The computer readable storage medium stores computer program instructions; when the computer program instructions are executed by the processor, the display method according to any one of the above embodiments is implemented.

It is to be understood that the present invention is not limited to the specific configurations and processes described above and illustrated in the drawings. For the sake of brevity, a detailed description of known methods is omitted here. In the above embodiments, several specific steps have been described and illustrated as examples. However, the method of the present invention is not limited to the specific steps described and illustrated, and those skilled in the art can make various changes, modifications and additions, or change the order between the steps after understanding the spirit of the present invention.

The functional blocks shown in the block diagrams described above may be implemented as hardware, software, firmware, or a combination thereof. When implemented in hardware, it can be, for example, an electronic circuit, an application specific integrated circuit (ASIC), suitable firmware, plug-ins, function cards, and the like. When implemented in software, the elements of the present invention are programs or code segments that are used to perform the required tasks. The program or code segment can be stored in a machine readable medium or transmitted over a transmission medium or communication link by a data signal carried in a carrier wave. A "machine-readable medium" can include any medium that can store or transfer information. Examples of machine-readable media include electronic circuits, semiconductor memory devices, ROM, flash memory, erasable ROM (EROM), floppy disks, CD-ROMs, optical disks, hard disks, fiber optic media, radio frequency (RF) links, and the like. The code segment can be downloaded via a computer network such as the Internet, an intranet, etc.

It should also be noted that the exemplary embodiments referred to in the present invention describe some methods or systems based on a series of steps or devices. However, the present invention is not limited to the order of the above steps, that is, the steps may be performed in the order mentioned in the embodiment, or may be different from the order in the embodiment, or several steps may be simultaneously performed.

It should be understood that the above embodiments are merely exemplary embodiments employed to explain the principles of the disclosure, but the disclosure is not limited thereto. Various modifications and improvements can be made by those skilled in the art without departing from the spirit and scope of the disclosure. These modifications and improvements are also considered to be within the scope of the disclosure.

What is claimed is:

1. A display method of a display panel, wherein the display panel comprises a plurality of pixel units, each of the pixel units comprises a mixed color subpixel and three single color subpixels, and lights emitted by the three single color subpixels are capable of being mixed to produce a light of a mixed color produced by the mixed color subpixel, the display method comprising:

obtaining original luminance of the three single color subpixels in each of the pixel units based on an image to be displayed, calculating luminance of a mixed color produced by the three single color subpixels based on a smallest luminance among the original luminance of the three single color subpixels, and obtaining a first substitute luminance of the mixed color subpixel based on the luminance of the mixed color, and first substitute luminance of the three single color subpixels except for the one having the smallest luminance, wherein one of the three single color subpixels which has the smallest luminance of the mixed color is denoted by A1, the other two of the three single color subpixels are denoted by A2 and A3, the first substitute luminance of A2 is obtained by subtracting luminance contributed by A2 in the mixed color based on A1 from the original luminance of A2, and the first substitute luminance of A3 is obtained by subtracting luminance contributed by A3 in the mixed color based on A1 from the original luminance of A3;

obtaining luminance compensation values of the three single color subpixels that need to be color compensated at a time of obtaining the luminance of the mixed color subpixel as the first substitute luminance, based on pre-stored color compensation ratios of the three single color subpixels, so as to obtain luminance of the three single color subpixels after color compensation;

calculating luminance of the mixed color produced by the three single color subpixels in the pixel unit respectively based on each of the luminance of the three single color subpixels after color compensation, based on pre-stored ratios of the lights emitted by the three single color subpixels mixed to produce the light of the mixed color emitted by the actual mixed color subpixel, wherein the smallest luminance of the mixed color is denoted by L11; and setting input luminance of A1 as 0, and obtaining actual luminance of A2, A3, and the mixed color subpixel based on L11, the pre-stored ratios of the lights emitted by the three single color subpixels mixed to produce the light of the mixed color emitted by the actual mixed color subpixel, the luminance of A2 and A3 after color compensation, and the first substitute luminance of the mixed color subpixel, and performing data input;

wherein the method further comprises, before calculating the luminance of the mixed color produced by the three single color subpixels:

obtaining chromaticity coordinates of the three single color subpixels and the mixed color subpixel in the display panel at given output luminance;

calculating ratios of the lights produced by the three single color subpixels mixed to produce the light of the mixed color emitted by the target mixed color subpixel, which are denoted by RatioAX1, RatioAX2, And RatioAX3 respectively, through a color mixing formula and based on chromaticity coordinate of a target mixed color subpixel;

calculating ratios of the lights produced by the three single color subpixels mixed to produce the light of the mixed color emitted by the actual mixed color subpixel, which are denoted by RatioBX1, RatioBX2, And RatioBX3 respectively, based on the chromaticity coordinates of the three single color subpixels and the chromaticity coordinate of the mixed color subpixel;

calculating the color compensation ratios of the three single color subpixels, which are denoted by gainX1, gainX2, and gainX3 respectively, based on RatioAX1, RatioAX2, RatioAX3, RatioBX1, RatioBX2, and RatioBX3; and storing RatioBX1, RatioBX2, RatioBX3, gainX1, gainX2, and gainX3.

2. The display method according to claim 1, wherein calculating luminance of the mixed color produced by the three single color subpixels in the pixel unit respectively based on each of the luminance of the three single color subpixels after color compensation further comprises:

calculating the luminance of the mixed color produced by the three single color subpixels according to the following formulas:

$$L_{11}=L_1/\text{Ratio}BX1,$$

$$L_{12}=L2/\text{Ratio}BX2,$$

$$L_{13}=L3/\text{Ratio}BX3,$$

where $L_{11}$, $L_{12}$, and $L_{13}$ are the luminance of the mixed color produced by A1, A2, and A3 based on each of the luminance of A1, A2, and A3 after color compensation, respectively.

3. The display method according to claim 2, wherein setting input luminance of A1 as 0, and obtaining actual luminance of A2, A3, and the mixed color subpixel based on L11, the pre-stored ratios of the lights emitted by the three single color subpixels mixed to produce the light of the mixed color emitted by the actual mixed color subpixel, the luminance of A2 and A3 after color compensation, and the first substitute luminance of the mixed color subpixel, and performing data input comprises:

setting the input luminance of A1 as 0, and calculating and storing the actual luminance of A2, A3, and the mixed color subpixel according to the following formulas:

$$L_{10'}=L_{11}+L_{10}$$

$$L_{12'}=L_{12}-L_{11}/\text{Ratio}BX2$$

$$L_{13'}=L_{13}-L_{11}/\text{Ratio}BX3$$

where $L_{10}$ represents the first substitute luminance of the mixed color subpixel, $L_{10'}$ represents the actual luminance of the mixed color subpixel, $L_{12'}$ represents the actual luminance of A2, and $L_{13'}$ is the actual luminance of A3.

4. The display method according to claim 3, wherein at most three subpixels among the mixed color subpixel and the three single color subpixels in each of the pixel units illuminate at the same time for display.

5. The display method according to claim 1, wherein the three single color subpixels in each of the pixel units comprises a red subpixel, a green subpixel, and a blue subpixel, and the mixed color subpixel comprises a white subpixel.

6. A display panel, comprising:

a plurality of pixel units, wherein each of the pixel units comprises a mixed color subpixel and three single color subpixels, and lights emitted by the three single color subpixels are capable of being mixed to produce a light of a mixed color produced by the mixed color subpixel;

a first calculating processor configured to obtain original luminance of the three single color subpixels in each of the pixel units based on an image to be displayed, calculate luminance of a mixed color produced by the three single color subpixels based on the smallest luminance among the original luminance the three single color subpixels, and obtain first substitute luminance of the mixed color subpixel based on the luminance of the mixed color, and first substitute luminance of the three single color subpixels except for the one having the smallest luminance, wherein one of the three single color subpixels which has the smallest luminance of the mixed color is denoted by A1, the other two of the three single color subpixels are denoted by A2 and A3, the first substitute luminance of A2 is obtained by subtracting luminance contributed by A2 in the mixed color based on A1 from the original luminance of A2, and the first substitute luminance of A3 is obtained by subtracting luminance contributed by A3 in the mixed color based on A1 from the original luminance of A3;

a second calculating processor, configured to obtain luminance compensation values of the three single color subpixels that need to be color compensated at a time of obtaining the luminance of the mixed color subpixel as the first substitute luminance, based on pre-stored color compensation ratios of the three single color subpixels, so as to obtain luminance of the three single color subpixels after color compensation;

a third calculating processor, configured to calculate luminance of the mixed color produced by the three single color subpixels in the pixel unit based on each of the luminance of the three single color subpixels after color compensation respectively, based on pre-stored ratios of the lights emitted by the three single color subpixels mixed to produce the light of the mixed color emitted by the actual mixed color subpixel, wherein the smallest luminance of the mixed color is denoted by L11; and a data writing processor, configured to set input luminance of A1 as 0, and obtain actual luminance of A2, A3, and the mixed color subpixel based on L11, the pre-stored ratios of the lights emitted by the three single color subpixels mixed to produce the light of the mixed color emitted by the actual mixed color subpixel, the luminance of A2 and A3 after color compensation, and the first substitute luminance of the mixed color subpixel, and perform data input;

wherein the display panel further comprises:

an acquisition processor, configured to obtain chromaticity coordinates of the three single color subpixels and the mixed color subpixel in the display panel at given output luminance;

a fourth calculating processor, configured to calculate ratios of the lights produced by the three single color subpixels mixed to produce the light of the mixed color emitted by the target mixed color subpixel, which are denoted by RatioAX1, RatioAX2, And RatioAX3 respectively, through a color mixing formula and based on chromaticity coordinate of a target mixed color subpixel; calculate ratios of the lights produced by the three single color subpixels mixed to produce the light of the mixed color emitted by the actual mixed color subpixel, which are denoted by RatioBX1, RatioBX2, And RatioBX3 respectively, based on the chromaticity coordinates of the three single color subpixels and the chromaticity coordinate of the mixed color subpixel; and calculate the color compensation ratios of the three single color subpixels, which are denoted by gainX1, gainX2, and gainX3 respectively, based on RatioAX1, RatioAX2, RatioAX3, RatioBX1, RatioBX2, and RatioBX3; and a storage processor, configured to store RatioBX1, RatioBX2, RatioBX3, gainX1, gainX2, and gainX3.

7. The display panel according to claim 6, wherein the third calculating processor is configured to calculate the luminance of the mixed color produced by the three single color subpixels in the pixel unit respectively based on each of the luminance of the three single color subpixels after color compensation according to the following formulas:

$$L_{11}=L_1/\text{Ratio}BX1$$

$$L_{12}=L2/\text{Ratio}BX2$$

$$L_{13}=L3/\text{Ratio}BX3$$

where $L_{11}$, $L_{12}$, and $L_{13}$ are the luminance of the mixed color produced by A1, A2, and A3 based on each of the luminance of A1, A2, and A3 after color compensation, respectively.

8. The display panel according to claim 7, wherein the data writing processor is configured to setting input luminance of A1 as 0, and calculate and store the actual luminance of A2, A3, and the mixed color subpixel according to the following formulas:

$$L_{10'}=L_{11}+L_{10}$$

$$L_{12'}=L_{12}-L_{11}\text{Ratio}BX2$$

$$L_{13'}=L_{13}-L_{11}/\text{Ratio}BX3$$

where $L_{10}$ represents the first substitute luminance of the mixed color subpixel, $L_{10'}$ represents the actual luminance of the mixed color subpixel, $L_{12'}$ represents the actual luminance of A2, and $L_{13'}$ is the actual luminance of A3.

9. The display panel according to claim 6, wherein the three single color subpixels in each of the pixel units comprise a red subpixel, a green subpixel, and a blue subpixel; and the mixed color subpixel comprises a white subpixel.

10. The display panel according to claim 6, wherein at most three subpixels among the mixed color subpixel and the three single color subpixels in each of the pixel units illuminate at the same time for display.

11. A display apparatus, comprising the display panel of claim 6.

12. A non-transitory computer readable storage medium having stored thereon computer program instructions, wherein when the computer program instructions are executed by a processor, a display method of a display panel is implemented, wherein the display panel comprises a plurality of pixel units, each of the pixel units comprises a mixed color subpixel and three single color subpixels, and lights emitted by the three single color subpixels are capable of being mixed to produce a light of a mixed color produced by the mixed color subpixel, the display method comprising:

obtaining original luminance of the three single color subpixels in each of the pixel units based on an image to be displayed, calculating luminance of a mixed color produced by the three single color subpixels based on a smallest luminance among the original luminance of the three single color subpixels, and obtaining a first substitute luminance of the mixed color subpixel based on the luminance of the mixed color, and first substitute luminance of the three single color subpixels except for the one having the smallest luminance, wherein one of the three single color subpixels which has the smallest luminance of the mixed color is denoted by A1, the other two of the three single color subpixels are denoted by A2 and A3, the first substitute luminance of A2 is obtained by subtracting luminance contributed by A2 in the mixed color based on A1 from the original luminance of A2, and the first substitute luminance of A3 is obtained by subtracting luminance contributed by A3 in the mixed color based on A1 from the original luminance of A3;

obtaining luminance compensation values of the three single color subpixels that need to be color compensated at a time of obtaining the luminance of the mixed color subpixel as the first substitute luminance, based on pre-stored color compensation ratios of the three single color subpixels, so as to obtain luminance of the three single color subpixels after color compensation;

calculating luminance of the mixed color produced by the three single color subpixels in the pixel unit respectively based on each of the luminance of the three single color subpixels after color compensation, based on pre-stored ratios of the lights emitted by the three single color subpixels mixed to produce the light of the mixed color emitted by the actual mixed color subpixel, wherein the smallest luminance of the mixed color is denoted by L11; and setting input luminance of A1 as 0, and obtaining actual luminance of A2, A3, and the mixed color subpixel based on L11, the pre-stored ratios of the lights emitted by the three single color subpixels mixed to produce the light of the mixed color emitted by the actual mixed color subpixel, the luminance of A2 and A3 after color compensation, and the first substitute luminance of the mixed color subpixel, and performing data input;

wherein the non-transitory computer readable storage medium further comprises, before calculating the luminance of the mixed color produced by the three single color subpixels:

obtaining chromaticity coordinates of the three single color subpixels and the mixed color subpixel in the display panel at given output luminance;

calculating ratios of the lights produced by the three single color subpixels mixed to produce the light of the mixed color emitted by the target mixed color subpixel, which are denoted by RatioAX1, RatioAX2, And RatioAX3 respectively, through a color mixing formula and based on chromaticity coordinate of a target mixed color subpixel;

calculating ratios of the lights produced by the three single color subpixels mixed to produce the light of the mixed color emitted by the actual mixed color subpixel, which are denoted by RatioBX1, RatioBX2, And RatioBX3 respectively, based on the chromaticity coordinates of the three single color subpixels and the chromaticity coordinate of the mixed color subpixel;

calculating the color compensation ratios of the three single color subpixels, which are denoted by gainX1, gainX2, and gainX3 respectively, based on RatioAX1, RatioAX2, RatioAX3, RatioBX1, RatioBX2, and RatioBX3, and storing RatioBX1, RatioBX2, RatioBX3, gainX1, gainX2, and gainX3.

13. The non-transitory computer readable storage medium according to claim 12, wherein calculating luminance of the mixed color produced by the three single color subpixels in the pixel unit respectively based on each of the luminance of the three single color subpixels after color compensation further comprises:

calculating the luminance of the mixed color produced by the three single color subpixels according to the following formulas:

$$L_{11}=L_1/\text{Ratio}BX1,$$

$$L_{12}=L2/\text{Ratio}BX2,$$

$$L_{13}=L3/\text{Ratio}BX3,$$

where $L_{11}$, $L_{12}$, and $L_{13}$ are the luminance of the mixed color produced by A1, A2, and A3 based on each of the luminance of A1, A2, and A3 after color compensation, respectively.

14. The non-transitory computer readable storage medium according to claim 13, wherein setting input luminance of A1 as 0, and obtaining actual luminance of A2, A3, and the mixed color subpixel based on L11, the pre-stored ratios of the lights emitted by the three single color subpixels mixed to produce the light of the mixed color emitted by the actual mixed color subpixel, the luminance of A2 and A3 after color compensation, and the first substitute luminance of the mixed color subpixel, and performing data input comprises:

setting the input luminance of A1 as 0, and calculating and storing the actual luminance of A2, A3, and the mixed color subpixel according to the following formulas:

$$L_{10'}=L_{11}+L_{10}$$

$$L_{12'}=L_{12}-L_{11}/\text{RatioBX2}$$

$$L_{13'}=L_{13}-L_{11}/\text{RatioBX3}$$

where $L_{10}$ represents the first substitute luminance of the mixed color subpixel, $L_{10'}$ represents the actual luminance of the mixed color subpixel, $L_{12'}$ represents the actual luminance of A2, and $L_{13'}$ is the actual luminance of A3.

15. The non-transitory computer readable storage medium according to claim 14, wherein the white subpixel and only two of the three single color subpixels illuminate to produce a color based on the original luminance of the three single color subpixels in each of the pixel units.

16. The non-transitory computer readable storage medium according to claim 12, wherein the three single color subpixels in each of the pixel units comprises a red subpixel, a green subpixel, and a blue subpixel, and the mixed color subpixel comprises a white subpixel.

17. The non-transitory computer readable storage medium according to claim 12, wherein at most three subpixels among the mixed color subpixel and the three single color subpixels in each of the pixel units illuminate at the same time for display.

* * * * *